United States Patent [19]

Groves

[11] Patent Number: 4,854,587

[45] Date of Patent: Aug. 8, 1989

[54] POP-UP PRACTICE BATTING TEE

[76] Inventor: Keith N. Groves, 3200 McLeod Dr., Apt. 210, Las Vegas, Nev. 89121

[21] Appl. No.: 167,495

[22] Filed: Mar. 14, 1988

[51] Int. Cl.[4] ..... A63B 69/40

[52] U.S. Cl. ..... 273/26 R

[58] Field of Search ..... 273/26 R, 29 A; 272/76, 272/77, 78; 446/325

[56] References Cited

U.S. PATENT DOCUMENTS

| | | | |
|---|---|---|---|
| 1,020,367 | 3/1912 | Patterson, Jr. | 272/78 |
| 2,037,508 | 4/1936 | Gilman | 272/76 |
| 2,458,306 | 1/1949 | Schneider | 273/26 R |
| 3,442,045 | 5/1969 | Green | 446/325 |
| 3,877,697 | 4/1975 | Lersch | 273/26 R |

*Primary Examiner*—Edward M. Coven
*Assistant Examiner*—T. Brown

[57] ABSTRACT

A new type of baseball and softball practice tee that is bendable and is quickly restored to its upright vertical position when hit during batting practice comprising an upright pedistal adapted at one terminal end to holding a ball, and the other end being inserted into the top end of an upright container the bottom end of which is flat and much smaller than the upper width of the container with the edges rounded upward making in effect a pear shaped container bottom, the bottom of the container possessing an enclosed cavity filled with weighted material of sufficient weight so as to force the container to quickly return to its vertical position when it is knocked over by the batter.

6 Claims, 1 Drawing Sheet

POP-UP PRACTICE BATTING TEE

BACKGROUND OF THE INVENTION

1. Field of the Invention

This invention relates to a new practice batting or hitting tee. More particularly, the invention relates to a baseball or softball practice tee which when accidentally hit will quickly be restored to its upright vertical position.

Specifically, the invention provides a new type of baseball and softball practice tee that is bendable and is quickly restored to its upright vertical position when accidentially hit during the batting practice. The new tee broadly comprises an upright pedistal adapted at one terminal end to holding a ball, such as a baseball or softball, and the other end being inserted into the top end of an upright container the bottom end of which is flat for only sufficient length to permit the container to stand upright and much smaller than the upper width of the container and with the edges rounded upward, making in effect a pear shaped container bottom, said bottom of the container possessing an enclosed cavity filled with weighted material of sufficient weight so as to force the said container to quickly return to its vertical position when it has been knocked over by the batter accidentally hitting the tee.

The invention further provides a preferred embodiment of the above-noted invention wherein the upright pedistal is adjustable and can be raised or lowered to fit the needs of the batter.

2. Prior Art

In the game of baseball, one of the most difficult skills to master is hitting. First, a hitter must be able to coordinate the swing of a bat with the location of a ball so that good contact with the ball can be made while swinging the bat. Once this is mastered, the hitter must next learn to make good contact with the ball at the various positions at which it may cross home plate, from an inside pitch to an outside pitch, and from a high pitch to a low pitch, and various combinations of these two variables.

In development of these skills, the trainer or coach uses a baseball tee to support a ball at a selected height above a representation of the baseball home plate. With the ball so positioned, the batter can practice swinging thereat to assist in the process of coordinating his hands with his eyes and in the development of his wrist and arm muscles.

Various practice batting tees have been developed in the past for this purpose. The practice tees developed todate, however, have had various limitations which have limited their overall acceptance in the baseball world. In some cases, the tees have been unstable and easily knocked over if the player hits the tee instead of the ball. This requires the batter to pick up the tee and reset it at the proper place, and this adds to the time and boredom of the practice sessions. In other cases, the tee has been firmly set on a large base and when hit instead of the ball, the stroke against the tee hurts the arms of the young players doing the hitting. In other cases, the tees have not been adjustable and different tees must be used for different hitting zones. In other cases, the tees have been very exemsove to produce, and the cost has been prohibitive for many of the smaller teams.

Following are examples of the prior art which discloses many of the tees having some of the above-noted limitations. U.S. Pat. No. 4,383,686, U.S. Pat. No. 4,277,691, U.S. Pat. No. 4,516,771, U.S. Pat. No. 2,862,712, U.S. Pat. No. 4,508,340, U.S. Pat. No. 3,877,695, U.S. Pat. No. 2,616,692 and U.S. Pat. No. 3,489,411.

It is an object of the invention, therefore, to provide a new practice batting tee for baseball and softball which corrects many of the above-described limitations. It is a further object to provide a practice batting tee which when accidentially hit quickly restores itself to the upright position. It is a further object to provide a practice batting tee which when accidentially hit does not hurt the arms of the batter. It is a further object to provide a new practice batting tee does not have to be reset when accidentially hit by the batter. It is a further object to provide a new type of practice batting tee that is easily assembled and economical to produce. It is a further object to provide a batting tee that is adjustable for high or low pitches. These and other objects of the invention will be apparent from the following detailed description thereof.

SUMMARY OF THE INVENTION

It has now been discovered that these and other objects of the invention can be accomplished by the new practice batting tees of the present invention which presents for the first time an efficient, economical and safe way for the training of young batters in all aspects of the hitting technique in a very short period of time.

The new practice batting tees of the present invention broadly comprises an upright pedistal adapted at one terminal end to holding a ball, such as a baseball or softball, and the other end attached to a container of such a configuration and with weights in the bottom so as to permit the tee to stand upright but when hit will bend over and then quickly return to the original upright position. Preferably the new practice tee comprising an elongated upright pedistal adapted at one terminal end to hold the ball and the other end being inserted into the top end of an upright container the bottom end of which is flat for only sufficient length to permit the container to stand upright and much smaller than the upper width of the container and with the edges rounded upward, making in effect a pear shaped container bottom, said bottom of the container possessing an enclosed cavity filled with weighted material of sufficient weight so as to force the said container to quickly return to its vertical position when it has been knocked over by the batter accidentially hitting the tee.

As a preferred embodiment of the above-described new practice tee, the upright pedistal is modified so as to permit it to be adjusted up or down according to the height of the batter. In this regard, the upright pedistal is preferably arranged so as to slip inside the top end of the upright container in telescopic manner with locking means at the top of the said container to lock the upright pedistal at the proper height.

It has surprisingly been found that the new practice batting tee described above solves many of the defects noted for the prior art tees. The new practice tee, for example, readily responds to any accidental hitting of the tee rather than the ball and bends forward when hit. In addition, after the tee has been bent forward, it readily adjusts itself and returns to the upright position due to the weights in the bottom of the container. Thus, when the tee is actually hit, the tee moves freely without any jar to the arms of the batter and there is no injury to his arms or wrist. In addition, as the tee readily recovers its position, there is no need for the batter to retrieve the tee and put in it its original position as this is done automatically by the weights in the bottom of the container.

Further advantage is found in the fact that the tee can be adjusted in height by raising or lowering the upright pedistal and locking it at the proper position for the individual batter. Thus, there is no need to possess a plurality of tees as one tee can be so adjusted to the proper height. The new tees are also inexpensive to product and can be made available at low cost to all coaches and trainers involving in training young ball players.

DESCRIPTION OF THE DRAWINGS

The various objects and features of the present invention will be more fully understood by reference to the accompanying drawings.

With reference to FIG. 1, the new practice batting tee 2 comprises a flexible tubular rod 7 joined to tubular member 3 which slides telescopically into tube 10 set within container 4. Locking means for holding tubular member 3 in place is shown as 8. Plug for removing the weight material at the bottom of container 4 is shown as 5. The removable baseball is shown at the top of the tee as 9.

FIG. 2, which is a cut away portion of the bottom of the container along line A shows the cavity at the bottom of container 4 with the upper roof of the cavity as 12, the cavity as 6 and weight material as 11. The plug for removing the weight material is shown as 5.

DETAILED DESCRIPTION OF THE INVENTION

Figure 1:
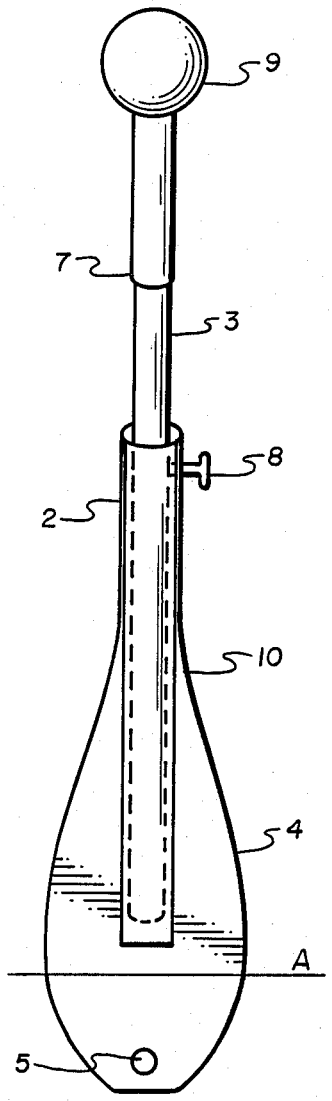
FIG. 1 is a front view of the new practice batting tee.
Figure 2:
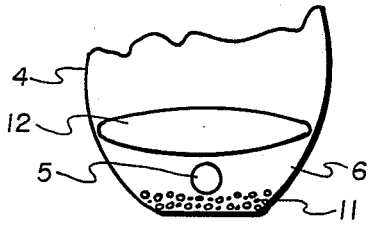
FIG. 2 is a cutaway portion of the bottom end of the container showing the closed cavity containing the weight material.

While the above-described description of the invention and drawing have been made in rather specific terms, it should be understood that various changes can be made in construction and operation without departing from the scope of the present invention.

The container portion of the batting tee can be prepared in any shape and of any material as long as it provides the required elements of holding the pedistal adapted to holding the ball as well as providing means for the quick recovery of the tee when accidentially hit. Preferably the container has a pear shape as shown in the drawing with the top portion narrowing to hold the pedistal adapted to holding the ball and the bottom portion expanded to hold the desired cavity with the weight material as well as a short flat portion at the bottom to permit the tee to stand upright on a relatively flat surface.

The preferred container is generally about 14 to 16 inches in height with the top portion narrowing to an opening sufficient to hold the tubular material adapted to holding the pedistal. Such top openings generally vary from about 1¾ inches to about 2 inches in diameter. The bottom of the container broadends out at the bottom to form the cavity area which is preferably about 5 to 7 inches in diameter. The bottom end of the container is flat for sufficient area to permit the tee to stand upright on a flat surface. The flat surface generally ranges from about 1½ to 3 inches in length. The cavity area is preferably only about 3 to 5 inches in height and can be filled or evacuated from a plugged opening at the bottom and side of the container.

The weight material added to the cavity area of the container can be of any suitable material as long as it adds the necessary weight of the upright tee. Sand, metal shot, water, etc. can be used as needed for this purpose. The amount of weight material added should only be that needed to effect a rapid return of the tee to the upright position and such can be determined by a series of routine experiments.

The container as well as the cavity area inside is preferably prepared from plastic material, such as polyvinyl chloride, polypropylene, polyurethane, and the like, or wood or metal materials can also be used as needed.

In the event the tee is made adjustable so that the pedistal can be raised or lower by sliding it down in over or the top end of the container, the container is preferably provided at the top end with a tubular member slightly larger than the pedistal, said tubular member extending down into the container of sufficient length to hold the pedistal in proper place. In most cases, such tubular member is preferably a metal or plastic pipe of diameter as noted slightly larger than that of the pedistal and may range from about 15/16 to 1½ inches in diameter.

In the event the tee is made adjustable as noted above, locking means is generally provide at the top side of the container to hold the pedistal in the proper place after adjustment. Any conventional locking means, such as bolts, clamps, etc. can be utilized as needed.

The pedistal to be attached to the above-noted container possessing the weight material can be of any size and construction as long as it provides means for holding the ball in proper place at the top and which can be attached to the said container. The pedistal can be made of one piece or can be made up of several pieces in adjustable manner. Preferably the pedistal is an elongated tubular member, such as a metal or plastic tube generally of about 3/4 to 1 inch in diameter. The length of the pedistal can vary according to the type of tee to be prepared, but in most cases generally vary from about 25 to 35 inches in length. The pedistal can be fixedly attached to the top of the above-noted container or can be adjustably attached to the said container by sliding within the top of the container and having a locking means at the top end of the container to retain the pedistal at the proper place. In this cases, the pedistal is preferably a tubular metal or plastic pipe of a smaller size than the tube within the container so that as the pedistal slides down in the container for adjustment, the pedistal is held in place by the locking means.

It is also desirable in some cases to provide a hard rubber tubular member at the top of the pedistal to also help in lessening the jar in case the batter hit the tee instead of the ball. In general, such rubber sections comprise a hard rubber tubular member of slightly larger diameter than the tubular pedistal so that it can slip over the top of said pedistal, and being of length preferably ranging from about 6 to 12 inches.

PREFERRED EMBODIMENT OF THE INVENTION

A preferred embodiment of the invention is described below. It should be understood, however, that this is given as a preferred assembly of apparatus for certain training schedules and is not to be regarded as limiting the invention in any way.

A practice batting tee is prepared as follows: A pedistal was prepared by selecting a 1½ inch polyvinyl chloride pipe of about 17 inches in length. To the top of this pipe was place about 12 inch length of hard rubber tubing which fit over the top of the polyvinyl chloride pipe, the upper end of said rubber tubing being of sufficient diameter to hold a baseball or softball. A container was then prepared by molding a pear shaped container having the following dimensions; height 16 inches, flat bottom of about 1½ inches slopping up for a height of about 5 inches to the widest portion of the container which was about 6 inches. A cavity was formed in the bottom of the container by placing a plastic divider about 3 inches above the bottom. A plug was placed at the side bottom of the container for introducing of weighted material in the cavity. The cavity so form was then filled with sand by means of the plug. A polyvinyl chloride pipe of about 1⅝ inches in diameter and about 10 inches was introduced at the top of the container into the center of the container so as to hold the pedistal when introduced. A locking means of a bolt threaded through the top side of the container and through the side of the polyvinyl chloride holding pipe to hold the pedistal when placed therein was then introduced.

The above-described pedistal was then placed inside the polyvinyl chloride holding pipe in the container and adjusted for the proper height of the player by means of the locking bolt. The assembled batting tee was then placed near home plate and a baseball placed on top of the pedistal and the tee was now ready for use for baseball practice.

The tee was used for batting practice for a little league team and it was found that when accidentally hit by the player, it quickly pop-up to its upright position so there was no need for recovery of the tee by the player. In addition, even when hit by the player there was no sudden jar to the arm of the player as the tee quickly bent with the hit.

I claim as my invention:

1. A quickly self righting practice batting tee comprising an upright pedistal adapted at one terminal end to holding a ball which may be placed thereon, and the other end being attached to an upright pear shaped container the bottom end of which is flat for a sufficient length to permit the said container to stand upright by itself with the edges of said bottom end curving upward to permit said container to be displaced downward when the batting tee is hit, and said bottom of the container being weighted so that said weight forces the container to quickly assume an upright position after it has been tilted from the upright position; locking means at the top of the side of the container to hold the pedestal firmly to the container when placed therein.

2. A batting tee as in claim 1 wherein the container also possesses a tubular member extending down from the top inside the container to hold the pedistal as it is placed within the container.

3. A batting tee as in claim 1 wherein the weighted material is water or sand.

4. A quickly self righting practice batting tee as in claim 1 which has a baseball on top of the said pedistal.

5. A quickly self righting practice tee as in claim 1 which has a softball on top of the said pedistal.

6. A quickly self righting practice batting tee as in claim 1 wherein the upright pedistal is adjustable relative to said container and is held in the top of the container by said locking means, said locking means being adjustable locking means.

* * * * *